US006486841B1

(12) United States Patent
Imahigashi

(10) Patent No.: US 6,486,841 B1
(45) Date of Patent: Nov. 26, 2002

(54) CAR ANTENNA

(75) Inventor: Hirotsugu Imahigashi, Saitama (JP)

(73) Assignee: Nippon Antena Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/787,745

(22) PCT Filed: Apr. 14, 2000

(86) PCT No.: PCT/JP00/02454

§ 371 (c)(1),
(2), (4) Date: Jun. 27, 2001

(87) PCT Pub. No.: WO01/08253

PCT Pub. Date: Feb. 1, 2001

(30) Foreign Application Priority Data

Jul. 22, 1999 (JP) ..... 11-207286

(51) Int. Cl.[7] ..... H01Q 1/32
(52) U.S. Cl. ..... 343/715; 343/906
(58) Field of Search ..... 343/702, 713, 343/715, 872, 906; H01Q 1/32

(56) References Cited

U.S. PATENT DOCUMENTS 4,200,874 A * 4/1980 Harada ..... 343/715
5,233,363 A * 8/1993 Yarsunas et al. ..... 343/715
5,945,952 A * 8/1999 Davidson ..... 343/702
6,100,852 A * 8/2000 Calcaro ..... 343/715
6,236,377 B1 * 5/2001 Hussaini et al. ..... 343/882
6,331,838 B1 * 12/2001 Scott et al. ..... 343/715

FOREIGN PATENT DOCUMENTS

| | | |
|---|---|---|
| JP | 10-22718 | 10/1988 |
| JP | 4-306007 | 4/1992 |
| JP | 11-274832 | 11/1999 |

* cited by examiner

*Primary Examiner*—Tho Gia Phan
(74) *Attorney, Agent, or Firm*—Connolly Bove Lodge & Hutz LLP

(57) ABSTRACT

With the object of a single worker being able to mount an automobile antenna, side plates of a board bracket 9 with fixing plate are inserted into a rectangular hole formed in the base portion 3 so that [the side plates] are located on the opposite side surfaces of a rectangular projecting portion projecting from the bottom surface of the base portion 3. Spring pieces 4*a* are formed on these side plates. When the cylindrical projecting portion 13 extending from the rectangular projecting portion is inserted in the mounting hole formed in the roof panel, the spring pieces 4*a* formed on the side plates pass through the mounting hole and engage with the back side thereof. The antenna body is thereby temporarily fixed to the roof panel and a worker can remove his or her hands from the antenna body. The worker then goes within the vehicle body, screws the fixing nut 2 onto the cylindrical projecting portion 13, and can thereby fix the automobile antenna on the roof panel.

4 Claims, 10 Drawing Sheets

CAR ANTENNA

TECHNICAL FIELD

The present invention relates to an automobile antenna whose antenna body, comprising an antenna element, is attached to the vehicle body.

BACKGROUND ART

This type of automobile antenna is generally mounted on the roof panel 20 of the automobile as shown in FIG. 10.

The antenna body 1 of this automobile antenna comprises an antenna cover 1*a* and an element portion 8 attached to the antenna cover 1*a;* a base portion, not shown, is fixed to the lower end of the antenna cover 1*a.* As shown in FIG. 11*a,* a cylindrical projecting portion 13 is formed on the lower surface of this base portion so as to project therefrom. The antenna body 1 is fixed to the roof panel 20 by screwing a fixing nut 2 onto this cylindrical projecting portion 13. In this case, the base portion of the cylindrical projecting portion 13 is a rectangular projecting portion. A rectangular antenna mounting hole 21 is formed in the roof panel 20, as shown in FIG. 11*b,* such that the rectangular projecting portion can be inserted therein.

When such an antenna body 1 is attached to the roof panel 20, the rectangular projecting portion formed on the base portion is inserted in a rectangular antenna mounting hole 21 formed in the roof panel 20, and a worker located outside the vehicle body holds the antenna body 1 so that the antenna body 1 will not come out of the antenna mounting hole 21. In this state, another worker located within the vehicle body screws the fixing nut 2 onto the cylindrical projecting portion 13 projecting into the vehicle body and tightens the fixing nut 2, whereby the antenna body 1 is affixed to the roof panel 20 as shown in FIG. 11*a.*

The element portion 8 may be constructed such that it can be removed from the antenna cover 1*a* so that the element portion 8 is not damaged from the impact of the rotating brushes or the like of a car washing machine when the vehicle is washed, or from contact with the ceiling of a garage when the vehicle is parked.

In this way, two workers, inside and outside the vehicle body, are needed to mount a conventional automobile antenna, and thus such conventional automobile has a problem that the large number of workers needed for the mounting operation.

It is an object of the present invention to provide an automobile antenna that can be mounted on the vehicle body by one worker.

DISCLOSURE OF THE INVENTION

In order to achieve the abovementioned object, the automobile antenna relating to the present invention comprises a base portion for fixing an antenna body having at least an antenna element to a vehicle body;

wherein a rectangular projecting portion to be inserted in a rectangular mounting hole formed in the vehicle body and a cylindrical projecting portion, extending from the rectangular projecting portion and onto which a fixing nut disposed inside the vehicle body is screwed, are formed so as to project from the lower surface of said base portion;

a fixing plate, whereon are formed spring portions for engaging with the edge of the mounting hole and temporarily fixing said antenna body to said vehicle body when said rectangular projecting portion is inserted in said mounting hole, is fixed to said base portion;

the fixing plate is formed to have a U-shaped cross section; said spring portions are formed on the opposite side plates thereof so as to incline outwards; and the side plates are inserted through holes formed in said base portion and project from the rear surface of said base portion.

Also, in the abovementioned automobile antenna relating to the present invention, a part of said side surface of said cylindrical projecting portion may be notched along the side plates of said fixing plate, so that the surfaces of the side plates of the fixing plate do not project outwards beyond the side surface of said cylindrical projecting portion.

Furthermore, in the abovementioned automobile antenna relating to the present invention, said fixing plate may be formed integrally as a single piece with a board bracket for holding a printed wiring board fixed to the surface of said base portion.

In addition, in the abovementioned automobile antenna relating to the present invention, said fixing plate may be held between and fixed to said base portion and said board bracket, by fixing the board bracket for supporting the printed wiring board to said base portion.

According to such an invention, the spring portions formed on the fixing plate can engage with the mounting hole and fix the antenna body to the vehicle body, when the rectangular projecting portion formed on the base portion is inserted in the mounting hole formed in the vehicle body. Consequently, the antenna body can be fixed on the vehicle body in this state by a worker entering the vehicle and screwing and tightening the fixing nut onto the threaded portion.

For this reason, the automobile antenna can be fixed to the vehicle body by just one worker.

Also, the fixing plate, which is formed to have a U-shaped cross section, is fixed by inserting the opposite side plates whereon are formed spring portions so as to incline outwards into the hole portion formed in the base portion; as a result, the fixing plate can be fixed with sufficient strength to the base portion. In this case, the board bracket formed as a single piece with the fixing plate is attached to the base portion, the fixing plate is held by the base portion and board bracket, and the board bracket is attached to the base portion thereby.

Furthermore, part of the side surface of the cylindrical projecting portion along the side plates of the fixing plate is cut away so that the surfaces of the side plates of the fixing plate do not project outside of the side surface of the cylindrical projecting portion. As a result, when the cylindrical projecting portion formed on the base portion is inserted in the mounting hole formed in the vehicle body, the cylindrical projecting portion can be smoothly inserted in the mounting hole, without the fixing plate located on the side surface of the cylindrical projecting portion striking the edge portion of the mounting hole.

BEST MODE FOR CARRYING OUT THE INVENTION

Figure 1:
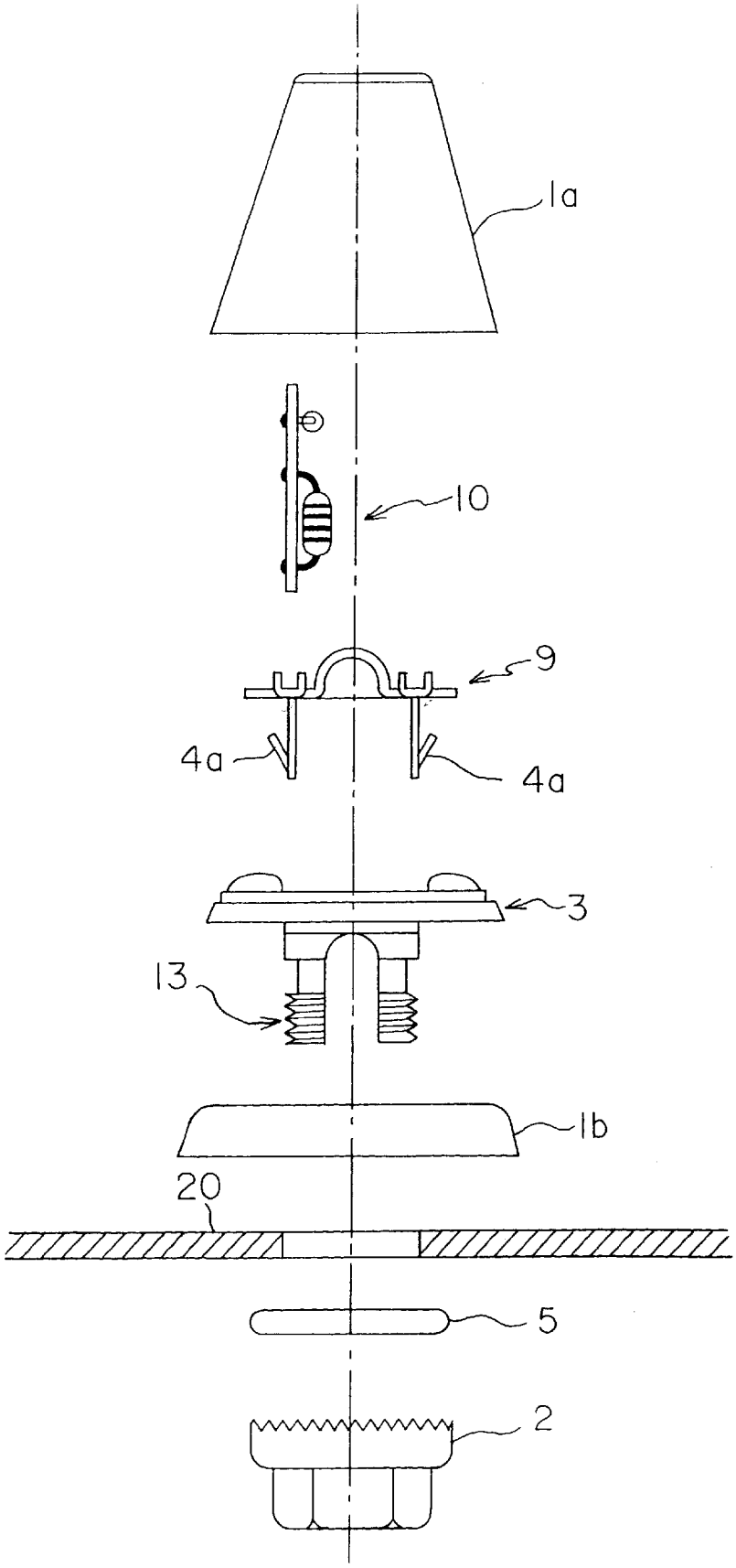
FIG. 1 shows an exploded view of the constitution of an embodiment of the automobile antenna relating to the present invention.
Figure 2:
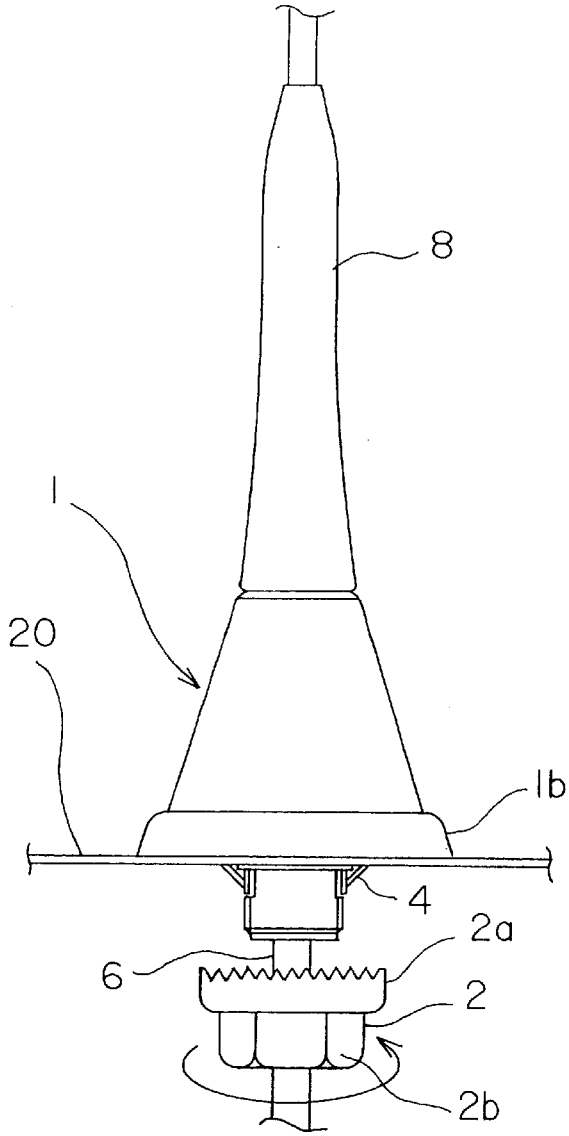
FIG. 2 shows the constitution of an embodiment of the automobile antenna relating to the present invention.
Figure 3:
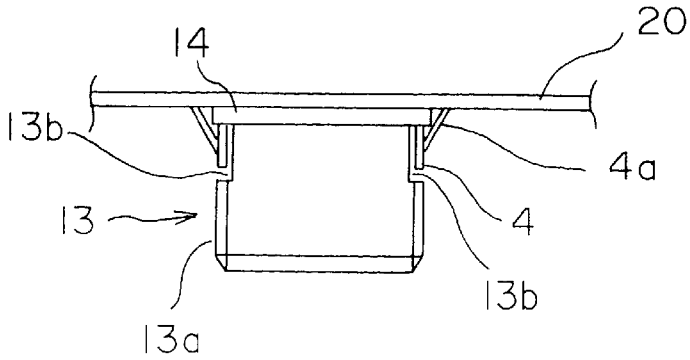
FIG. 3 shows an enlarged view of principal elements of an embodiment of the automobile antenna relating to the present invention.

FIGS. 1 through 3 show examples of the constitution of an embodiment of the automobile antenna relating to the present invention.

FIG. 1 is an exploded view showing the constitution of an embodiment of the automobile antenna relating to the present invention; FIG. 2 is a front view showing the constitution of an embodiment of the automobile antenna relating to the present invention; and FIG. 3 is an enlarged view showing a detail of principal elements located on the lower portion of the vehicle body in an embodiment of the automobile antenna relating to the present invention.

As shown in these figures, the automobile antenna relating to the present invention comprises an antenna body 1 and a fixing nut 2 for attaching the antenna body 1 on the vehicle body. The antenna body 1 comprises an element portion 8 and an antenna cover 1*a* to which the element portion 8 is fixed. An antenna top with a diameter greater than that of the element portion 8 is attached to the top end of the element portion 8. The bottom portion of the element portion 8 is a molded portion that is molded of a flexible synthetic resin such as rubber. A trap coil connected to the element may be enclosed in this molded portion.

Because the flexible molded portion in the lower portion of the element portion 8 bends when external force is applied to the antenna, this molded portion absorbs the external force applied and prevents breakage of the element portion 8.

The electrical length from the antenna top to the base portion of the antenna body of the element portion 8 constituted in this way is one quarter wavelength of the FM radio band, for example. The electrical length from the base portion to the bottom end of the trap coil is one quarter wavelength of the portable wireless phone band. Consequently, this automobile antenna resonates in both the portable wireless phone band and FM radio band and can also receive the AM radio band with the entire antenna body 1.

The antenna cover 1*a,* whereon the element portion 8 is fixed, is fit onto the base portion 3 and screwed and fixed with a pair of fixing vises. Then, the board bracket 9, with the fixing plate, is fixed to the base portion 3. A printed wiring board 10 is fixed to this board bracket 9. In other words, the printed wiring board 10 is disposed in the space formed between the antenna cover 1*a* and the base portion 3, and a matching circuit, amplifying circuit, and divider are incorporated in this printed wiring board 10.

Figure 11A:
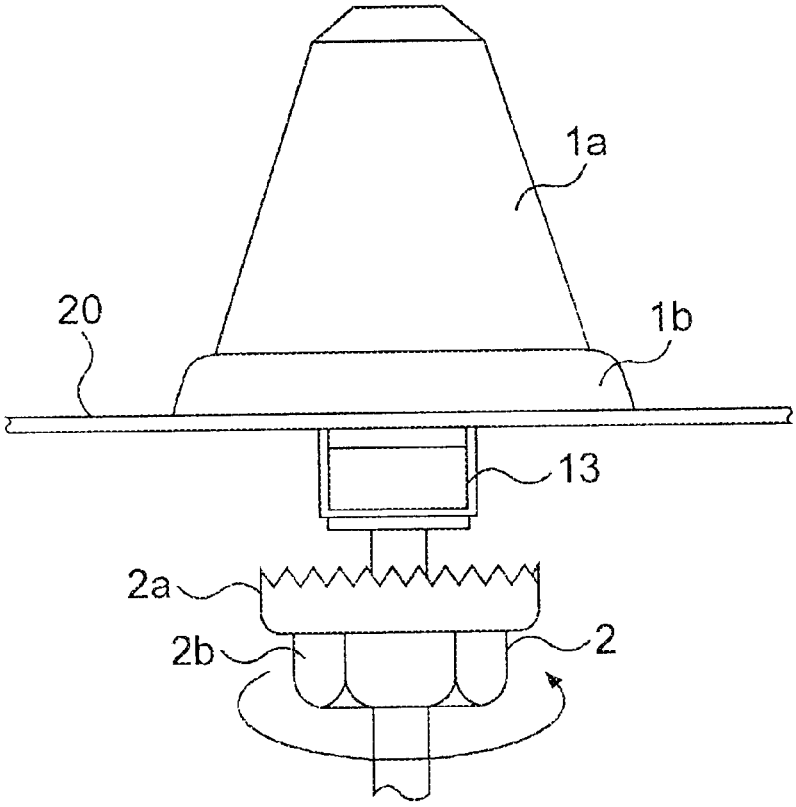
FIG. 11a PRIOR ART
FIG. 11*a* is a diagram for explaining the method for mounting a conventional automobile antenna.
Figure 11B:
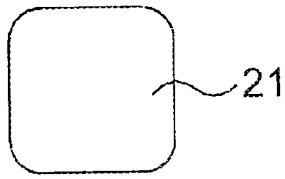
FIG. 11b PRIOR ART
FIG. 11*b* is a diagram showing the rectangular antenna mounting hole.

A rectangular projecting portion 14 and a cylindrical projecting portion 13 having a round cross section and extending from the rectangular projecting portion 14, are formed on the bottom surface of the base portion 3. A rectangular antenna mounting hole 21, as shown in the abovementioned FIG. 11*b,* is formed in the roof panel 20 whereon the antenna body 1 is mounted. The rectangular projecting portion 14 serving as the base for the cylindrical projecting portion is inserted in this antenna mounting hole 21. Inserting the rectangular projecting portion 14 into the rectangular antenna mounting hole 21 can prevent the turning of the antenna body 1 relative to the antenna mounting hole 21 when the fixing nut 2 is tightened.

For waterproofing, a pad 1*b* made of rubber or the like is fit into the periphery of the base portion 3, and an O-ring 5, consisting of an elastic, ring-shaped body is fit onto the rectangular projecting portion 14 and inserted into the antenna mounting hole 21.

Figure 10:
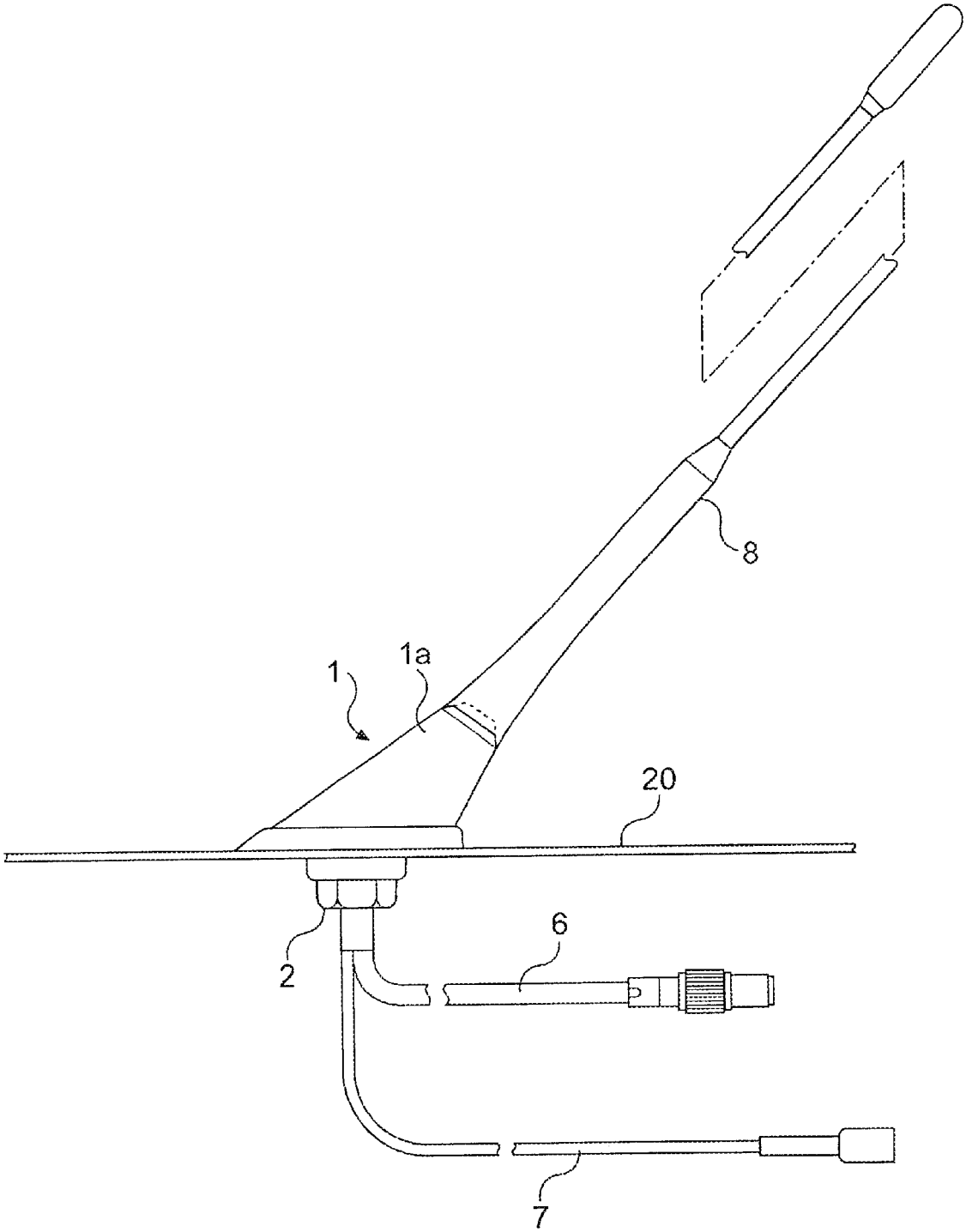
FIG. 10 PRIOR ART
FIG. 10 is a diagram showing the overall constitution of the automobile antenna.

Further, a through hole and a slot along the through hole are formed inside the rectangular projecting portion 14 and cylindrical projecting portion 13. A coaxial cable 6 for transmitting signals and power supply line 7 for supplying power to the printed wiring board 10 within the antenna cover 1*a* as shown in FIG. 10, are passed through the through hole and slot.

In addition, as shown in the detailed view of the base portion 3 in FIG. 4, two elongated rectangular holes 14*a* are formed passing through from the base portion 3 at positions on opposite sides of the rectangular projecting portion 14. Furthermore, as shown in an enlarged view in FIG. 3, a notched portion 13*b* is formed opposite to the cylindrical projecting portion 13 at positions where the two rectangular holes 14*a* extend. The notched portion 13*b* is formed to extend to the midway of the cylindrical projecting portion 13.

The two opposing side plates bent from the board bracket 9 with fixing plate are inserted respectively in the two rectangular holes 14*a* formed in the base portion 3 and project from the back surface of the base portion 3 as shown in FIGS. 2 and 3. These side plates are provided with spring pieces 4*a,* formed so as to incline to the outside. When passed through the rectangular antenna mounting hole 21 formed in the roof panel 20, these spring pieces 4*a* are bent inwards by the edge of the antenna mounting hole 21, and upon passing through the antenna mounting hole 21, return to their original form as shown and project from the antenna mounting hole 21. As a result, when the cylindrical projecting portion 13 and rectangular projecting portion 14 are inserted through the antenna mounting hole 21, the spring pieces 4*a* engage with the back surface of the roof panel 20 and thus the antenna body 1 is temporarily anchored to the roof panel 20.

As noted above, the notched portion 13*b* opposite to the cylindrical projecting portion 13 is formed for the following reason. The side plates of the board bracket 9 with fixing plate reach beyond the rectangular projecting portion 14 to the cylindrical projecting portion 13. When the side plates of the board bracket 9 with fixing plate project from the outer surface of the cylindrical projecting portion 13, the projecting side plates of the board bracket 9 with fixing plate strike against the antenna mounting hole 21 and impede smooth insertion of the cylindrical projecting portion 13, when the cylindrical projecting portion 13 is inserted through the antenna mounting hole 21.

After the cylindrical projecting portion 13 and rectangular projecting portion 14 are inserted through the antenna mounting hole 21, the antenna body 1 is temporarily anchored to the roof panel 20 by the action of the spring pieces 4*a*. Consequently, without the antenna body 1 being held, the fixing nut 2 can be screwed, from within the vehicle body, onto the threaded portion 13*a* formed on the outer surface of the cylindrical projecting portion 13 of the temporarily anchored antenna body 1. This fixing nut 2 comprises a washer portion 2*a,* with triangular projections, and nut portion 2*b*. The washer portion 2*a* is assembled rotatably relative to the nut portion 2*b*. In other words, when the nut portion 2*b* is rotated, the triangular tips of the washer portion 2*a* bite into the back surface of the roof panel 20 so that the antenna body 1 can be attached securely to the roof panel 20. In this way the antenna body 1 can be mounted on the roof panel 20 by one worker.

Figure 4A:
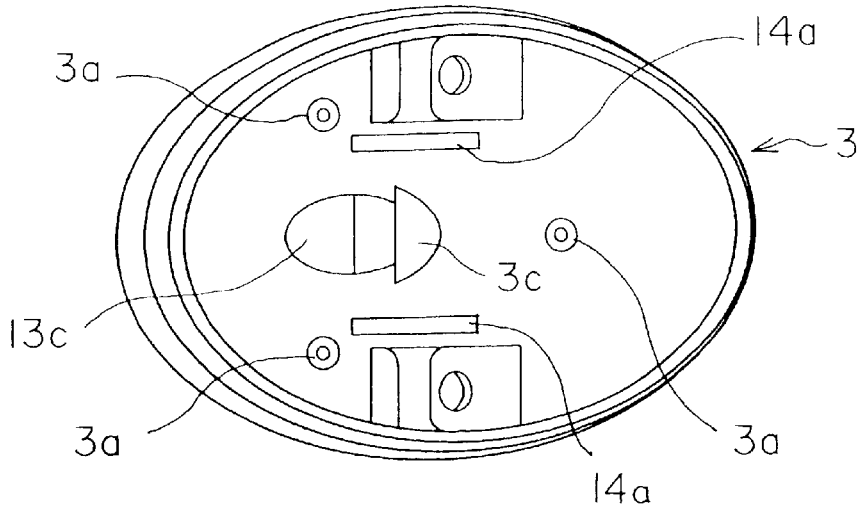
FIG. 4*a* shows a top view showing the detailed constitution of the base portion of an embodiment of the automobile antenna relating to the present invention.
Figure 4B:
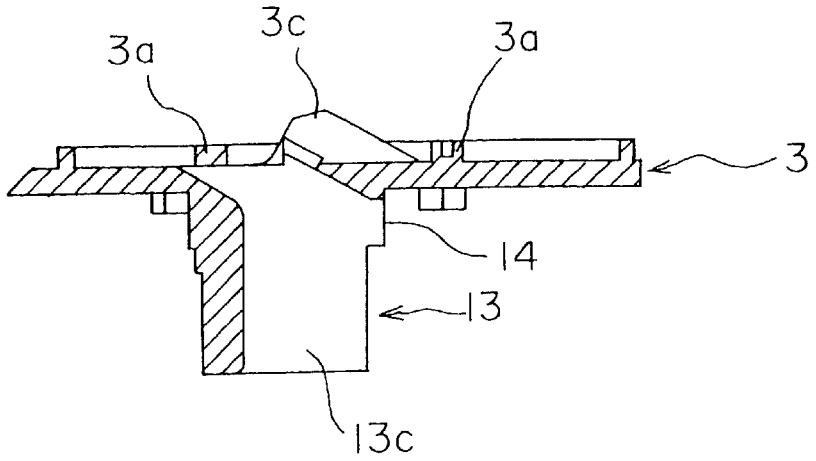
FIG. 4*b* is a cross sectional view showing the detailed constitution of the base portion of an embodiment of the automobile antenna relating to the present invention.

Next, the detailed constitution of the base portion 3 is explained with reference to FIG. 4 in which FIG. 4*a* is a plan view, FIG. 4*b* a side view, and FIG. 4*c* a rear view of the base portion.

The base portion 3 is a die-cast metal and has generally elliptical shape. The through hole 13*c* is formed in the center thereof, extending to the rectangular projecting portion 14 and cylindrical projecting portion 13 formed so as to project from the back surface of the base portion 3. The slot 13*d* is formed in one surface of the through hole 13*c* as shown in FIG. 4*c*. This slot 13*d* is provided not only for drawing the coaxial cable 6 and power supply line 7 inserted into the through hole 13*c* in a generally orthogonal direction with respect to the roof panel 20 as shown in FIG. 2, but also for drawing the coaxial cable 6 and power supply line 7 in a generally parallel direction with respect to the roof panel 20 by locating the coaxial cable 6 in the slot 13*d*. Further, the upper portion of the through hole 13*c* is inclined as shown in FIG. 4*b* so that the coaxial cable 6 and power supply line 7, which are inserted through the through hole 13*c* from the surface of the base portion 3, can be drawn along the surface; meanwhile, the guide 3*c* is provided on the surface so as to project and cover part of the through hole 13*c*.

Figure 4C:
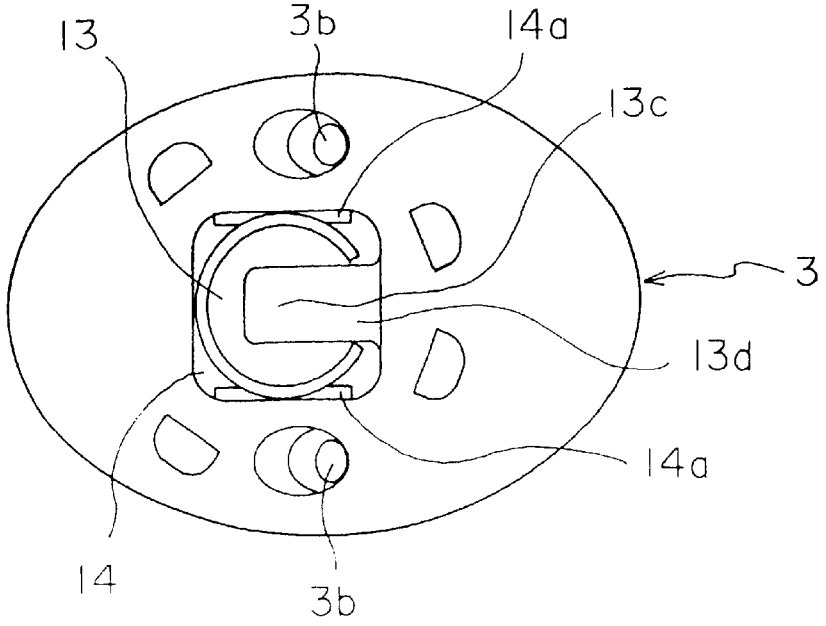
FIG. 4*c* is a bottom view showing the detailed constitution of the base portion of an embodiment of the automobile antenna relating to the present invention.

Further, as shown in FIGS. 4*a* and 4*c,* two elongated rectangular holes 14*a* are formed to extend from the surface to the rear surface of the base portion 3. These rectangular holes 14*a* are holes through which the side plates, whereon are formed the spring pieces 4*a* of the board bracket 9 with fixing plate, are inserted, as discussed above. Furthermore, three engaging projections 3*a* are formed at the vertices of a triangle on the surface of the base portion 3 as shown in FIG. 4*a*. These engaging projections 3*a* are projections for caulking and fixing the board bracket 9 with fixing plate as discussed below. Furthermore, the wall to which the antenna cover 1*a* fits is provided along the elliptical edge of the base portion 3. Furthermore, threaded holes 3*b,* through which are inserted two screws for fixing the engaged antenna cover la to the base portion 3, are formed on the rear surface of the base portion 3.

Next the detailed constitution of the board bracket 9 with fixing plate is explained with reference to FIG. 5. The board bracket 9 with fixing plate shown in FIG. 5 is a first example of the fixing plate, in which the fixing plate and board bracket formed integrally as a single piece by punching and then bending a metal plate.

Figure 5A:
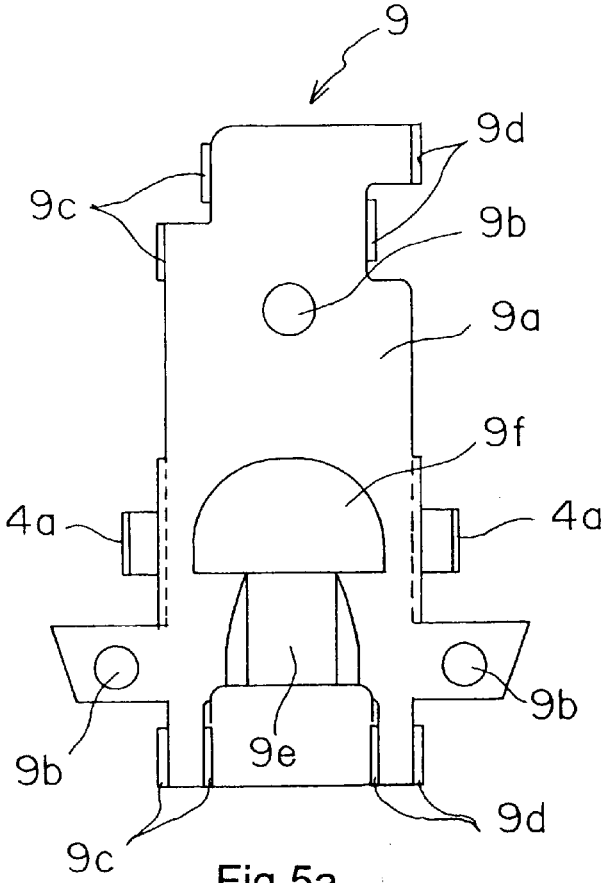
FIG. 5*a* is a plan view showing the detailed constitution of a board bracket with the fixing plate of an embodiment of the automobile antenna relating to the present invention.
Figure 5B:
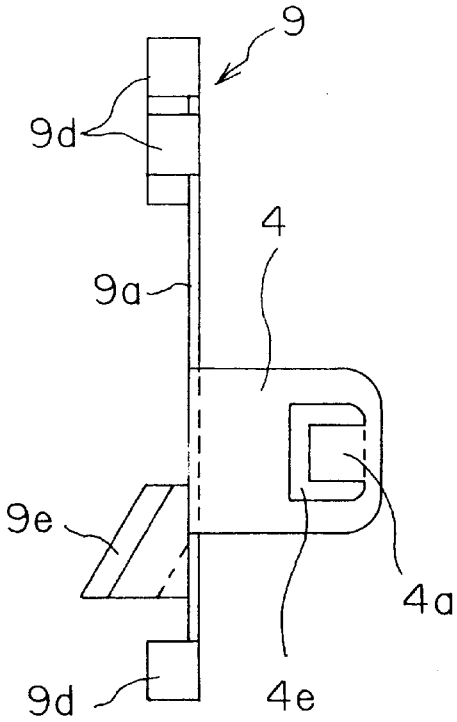
FIG. 5*b* is a side view showing the detailed constitution of a board bracket with the fixing plate of an embodiment of the automobile antenna relating to the present invention.
Figure 5C:
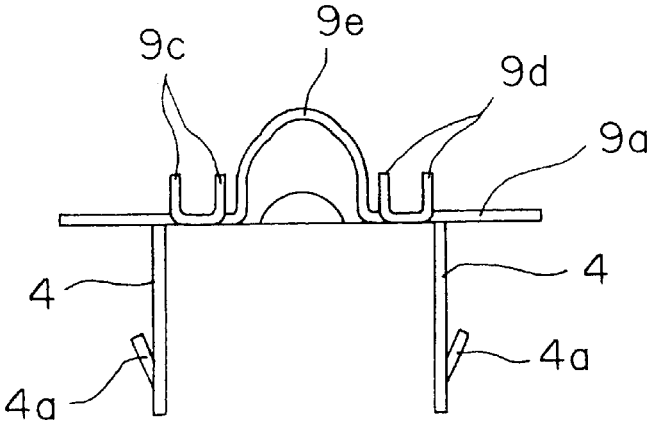
FIG. 5*c* is a front view showing the detailed constitution of a board bracket with the fixing plate of an embodiment of the automobile antenna relating to the present invention.

FIG. 5*a* is a plan view, FIG. 5*b* is a side view thereof, and FIG. 5*c* is a front view of the board bracket 9 with fixing plate. As shown in these figures, the board bracket 9 with fixing plate comprises a flat body 9*a* and two opposite side plates 4 bent orthogonal to the body 9*a*. Rectangular spring pieces 4*a* are formed by providing U-shaped slots 4*e* on the side plates 4. As shown in the drawings, the upper ends of the spring pieces 4*a* are bent so as to be apart from the side plates 4.

Also, three engaging holes 9*b* are formed at the vertices of a triangle in the body 9*a,* while a generally semicircular notched portion 9*f* is formed in the center thereof. The engaging holes 9*b* are holes for engaging each of the engaging projections 3*a* formed in the base portion 3. After the side plates 4 are inserted through the rectangular holes 14*a* in the base portion 3 and the engaging holes 9*b* are engaged with the engaging projections 3*a,* the board bracket 9 with fixing plate can be fixed to the base portion 3 by caulking the engaging projections 3*a*. The notched portion 9*f* is provided so that, when the board bracket 9 with fixing plate is fixed to the base portion 3, the guide 3*c* formed on the base portion 3 projects upwards from the board bracket 9 with fixing plate, but does not interfere therewith.

Furthermore, a pair of board supporting portions 9*c* and 9*c* are formed on the front and rear portions of the body 9*a*. The printed wiring board 10, in which a matching circuit, amplifying circuit, and divider are incorporated, is held between these board supporting portions 9*c* and 9*d* and soldered thereto, whereby it is electrically and mechanically supported.

In addition, an inclined bulging portion 9*e* is formed on the front portion of the body 9*a*. This bulging portion 9*e* serves as a guide when the coaxial cable 6 and power supply line 7 inserted through the through hole 13*c* are extended.

Figure 6A:
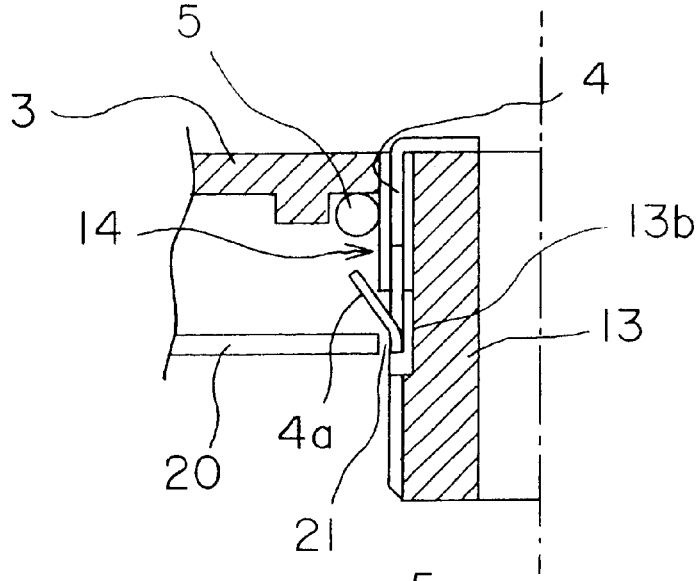
FIG. 6*a* is a diagram showing the initial stage of mounting the base portion on the roof panel for an embodiment of the automobile antenna relating to the present invention.
Figure 6B:
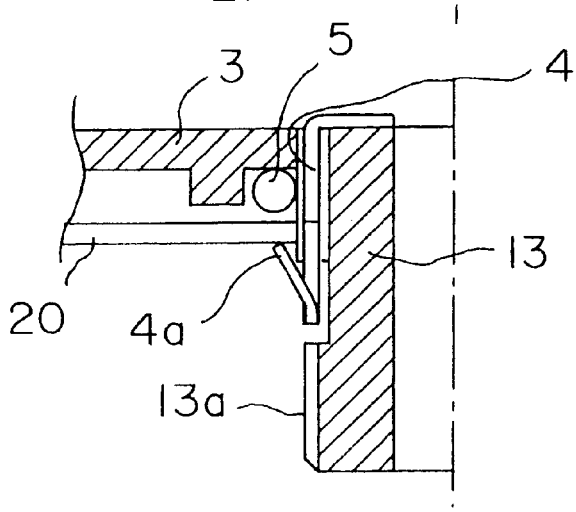
FIG. 6*b* is a diagram showing the next stage of mounting the base portion on the roof panel for an embodiment of the automobile antenna relating to the present invention.
Figure 6C:
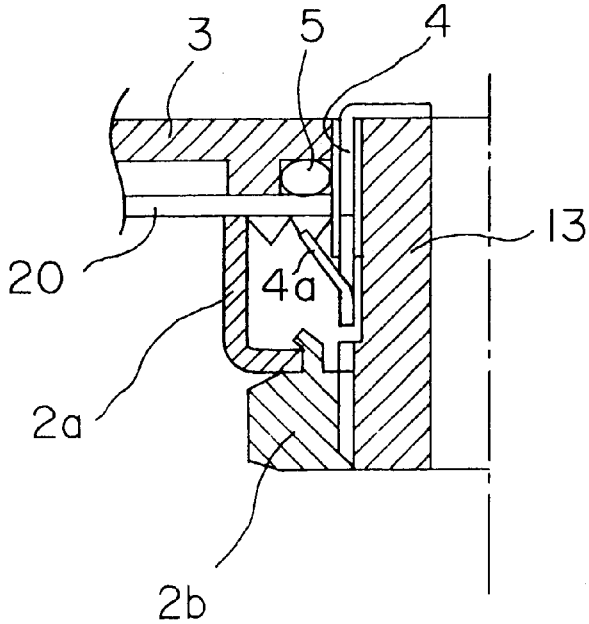
FIG. 6*c* is a diagram showing the final stage of mounting the base portion on the roof panel for an embodiment of the automobile antenna relating to the present invention.

FIGS. 6*a*, 6*b*, and 6*c* show each step of the process for attaching the board bracket 9 with fixing plate to the base portion 3 constituted as discussed above, assembling the antenna body 1, and mounting it on the roof panel 20.

FIG. 6*a* shows the stage wherein the end portion of the cylindrical projecting portion 13, on the antenna body 1, is inserted in the rectangular antenna mounting hole 21 formed in the roof panel 20. The spring pieces 4*a* formed on the side plates 4 are not yet inserted in the antenna mounting hole 21.

FIG. 6*b* shows the stage wherein the cylindrical projecting portion 13 is inserted in the antenna mounting hole 21. The spring pieces 4*a* formed on the side plates 4 pass through the antenna mounting hole 21 and abut on the back surface of the roof panel 20. The antenna body 1 is thereby temporarily held on the roof panel 20; as a result, the fixing nut 2 can be screwed onto the threaded portion 13*a* of the cylindrical projecting portion 13 without the antenna body 1 being held [by an operator]. The side plates 4 can be smoothly inserted without striking the edges of the antenna mounting hole 21 because the surfaces of the side plates 4 are prevented from projecting outwards from the outer surface of the cylindrical projecting portion 13, since the side plates 4 are located in the notched portion 13*b* formed in the cylindrical projecting portion 13.

FIG. 6*c* shows the stage wherein the fixing nut 2 is screwed on the threaded portion 13*a* formed on the outside of the cylindrical projecting portion 13 inserted in the antenna mounting hole 21. The pointed tips on the end of the washer portion 2*a* of the fixing nut 2 screwed thereon are caused to bite into the back surface of the roof panel 20. The antenna body 1 is thereby fixed securely to the roof panel 20. The O-ring 5 that is fit over the edge of the rectangular projecting portion 14 is pressed between the back surface of the base portion 3 and the roof panel 20 and prevents the leakage of water from the surface of the roof panel 20.

Next, FIG. 7 shows a second constitution for the fixing plate. The fixing plate 24 shown in FIG. 7 is constituted of fixing plate unit and is prepared by punching and then bending a metal plate.

Figure 7A:
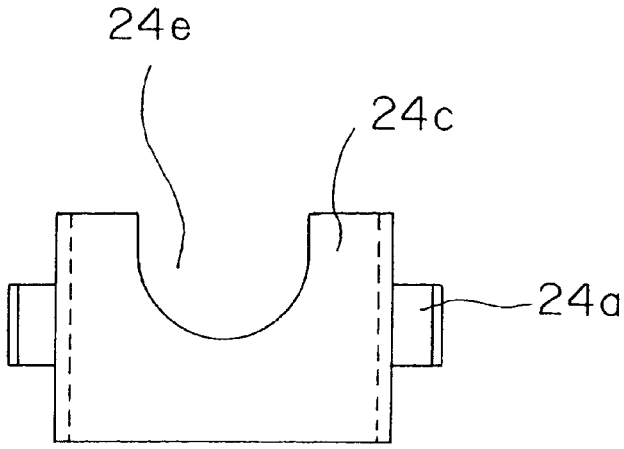
FIG. 7*a* is a plan view showing a second constitution of fixing plate of an embodiment of the automobile antenna relating to the present invention.
Figure 7C:
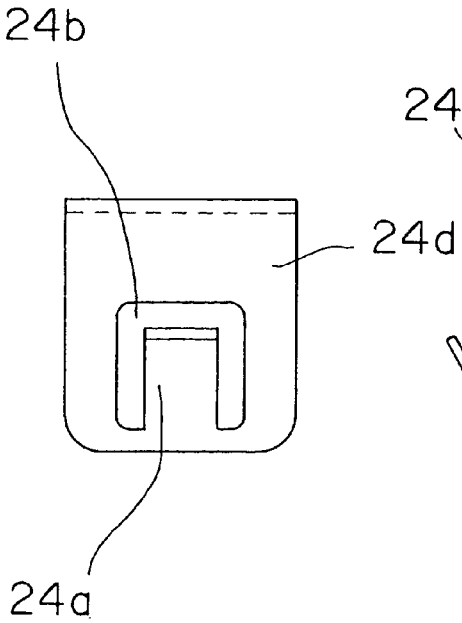
FIG. 7*c* is a front view showing the second constitution of fixing plate of an embodiment of the automobile antenna relating to the present invention.
Figure 7B:
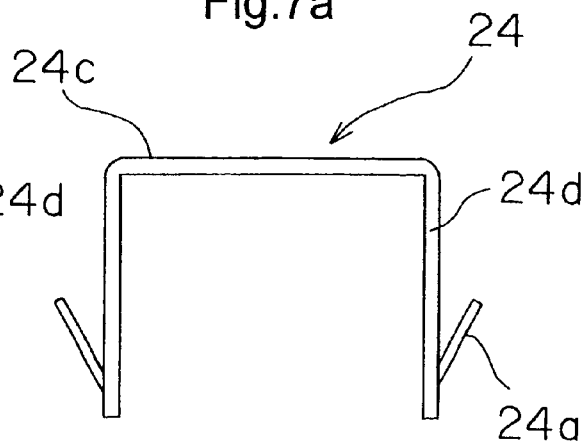
FIG. 7*b* is a side view showing the second constitution of fixing plate of an embodiment of the automobile antenna relating to the present invention.

FIG. 7*a* is a plan view, FIG. 7*b* is a side view thereof, and FIG. 7*c* is a front view of the fixing plate 24. As shown in these figures, the fixing plate 24 comprises a flat upper plate 24*c* and two opposing side plates 24*d* formed by bending the sides of the upper plate 24*c* orthogonal [to the upper plate 24*c*]. Rectangular spring pieces 24*a* are formed by establishing notched portions 24*b* with a squared U shape in the side plates 24*d*; as shown in the figure, the upper ends of the spring pieces 24*a* are bent away from the side plates 24*d*. These side plates 24*d* are inserted in the rectangular holes 14*a* in the base portion 3 so as to locate the spring pieces 24*a* on the back surface of the base portion 3.

Also, a semicircular notched 24*e* is formed in one edge of the upper plate 24*c*. The semicircular notch 24*e* is formed so that, when the fixing plate 24 is fixed to the base portion 3, the guide 3*c* formed in the base portion 3 is not caused to protrude upwards from the fixing plate 24 and interfere.

The side plates 24*d* of the fixing plate 24 constituted in this way are inserted in the rectangular hole 14*a* in the base portion 3, the board bracket is mounted thereon, and the board bracket is caulked and fixed to the base portion 3, so that the fixing plate 24 is held and fixed by the base portion 3 and board bracket. The detailed constitution of the board bracket is shown in FIG. 8.

Figure 8A:
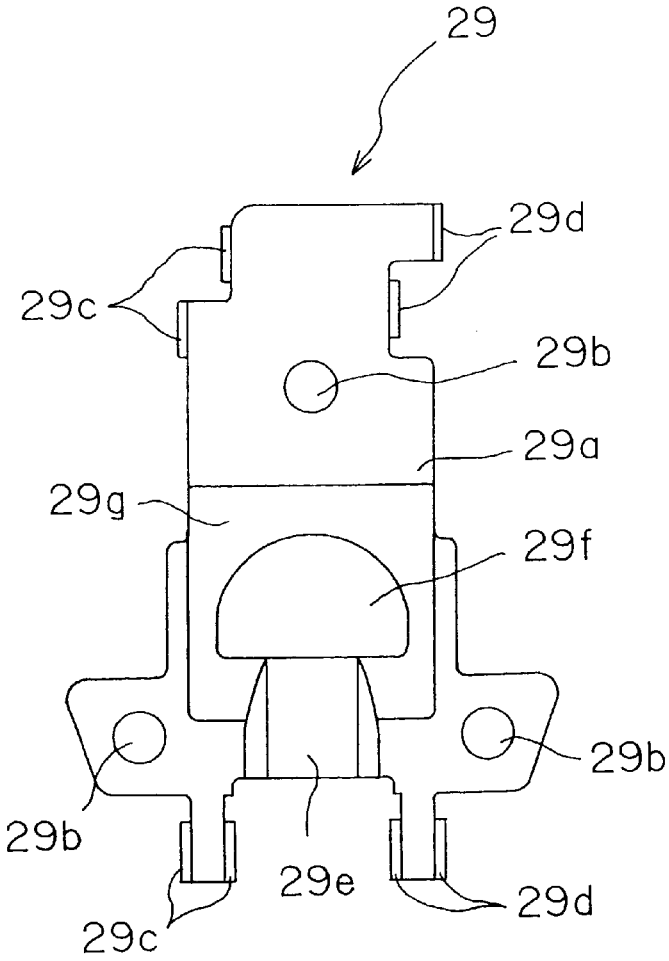
FIG. 8*a* is a plan view showing the detailed constitution of the board bracket of an embodiment of the automobile antenna relating to the present invention.
Figure 8B:
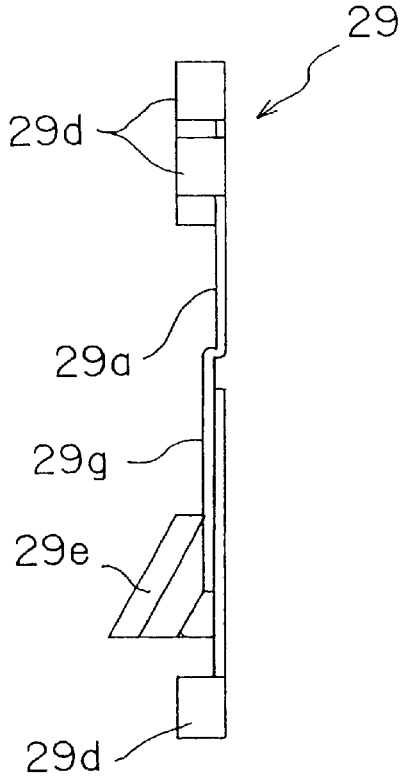
FIG. 8*b* is a side view showing the detailed constitution of the board bracket of an embodiment of the automobile antenna relating to the present invention.
Figure 8C:
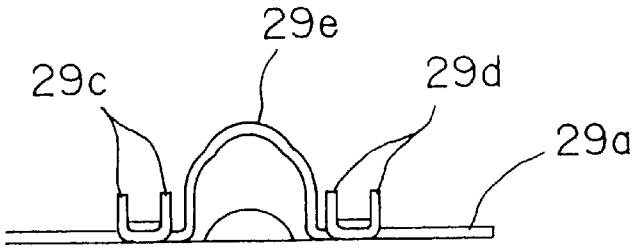
FIG. 8*c* is a front view showing the detailed constitution of the board bracket of an embodiment of the automobile antenna relating to the present invention.
Figure 9A:
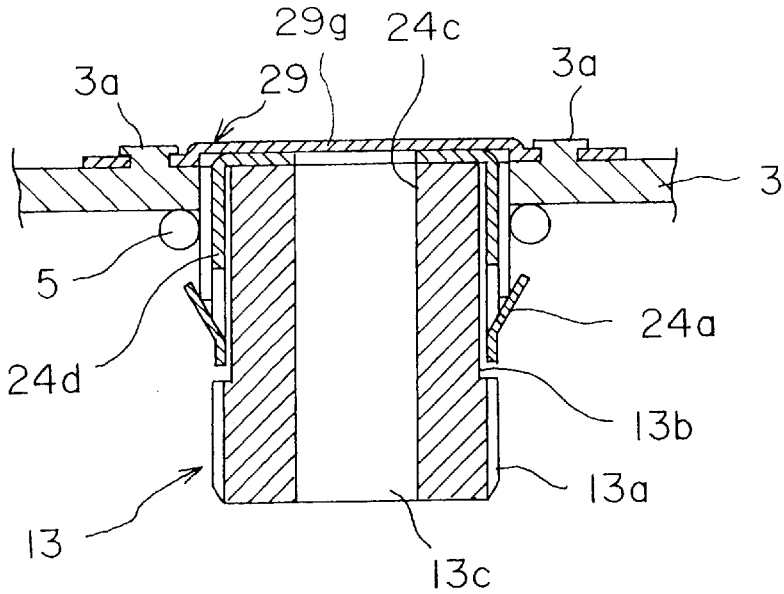
FIG. 9*a* is a cross sectional view showing the constitution when the fixing plate and board bracket are constituted as separate bodies in an embodiment of the automobile antenna relating to the present invention.

FIG. 8*a* is a plan view, FIG. 8*b* is a side view, and FIG. 8*c* is a front view of the board bracket 29. The board bracket 29 shown in these figures comprises a flat body 29*a*. Three engaging holes 29*b* are formed at vertices of a triangle on the body 29*a* and a semicircular notched portion 29*f* is formed in the approximate center thereof. The engaging holes 29*b* are holes for anchoring the engaging projections 3*a* formed on the base portion 3. After the side plates 24*d* of the fixing plate 24 are inserted through the rectangular holes 14*a* of the base portion 3 and the engaging projections 3*a* are anchored in the engaging holes 29*b*, the engaging projections 3*a* are caulked; the board bracket 29 can thereby be fixed to the base portion 3 as shown in FIG. 9*a*.

The notched portion 29*f* is formed so that, when the board bracket 29 is fixed to the base portion 3, the guide 3*c* formed in the base portion 3 is not caused to protrude from the board bracket 29 and interfere. A stage portion 29*g* is formed to as to surround this notched portion 29*f*. The size of this stage portion 29*g* is formed so as to slightly exceed that of the upper plate 24*c* of the fixing plate 24, so that the upper plate 24*c* can be housed within the stage portion 29*g*.

Furthermore, a pair of board support portions 29*c*, 29*d* are formed on the front and rear portions of the body 29*a*. The printed wiring board 10, in which a matching circuit, amplifying circuit, and divider are incorporated, is held between and soldered to these board support portions 29*c*, 29*d*, whereby it is electrically and mechanically held.

Furthermore, an inclined bulging portion 29*e* is formed on the front portion of the body 20*a*. This bulging portion 19*e* serves as a guide when the coaxial cable 6 and power supply line 7 inserted in the through hole 13*c* are extended.

Figure 9B:
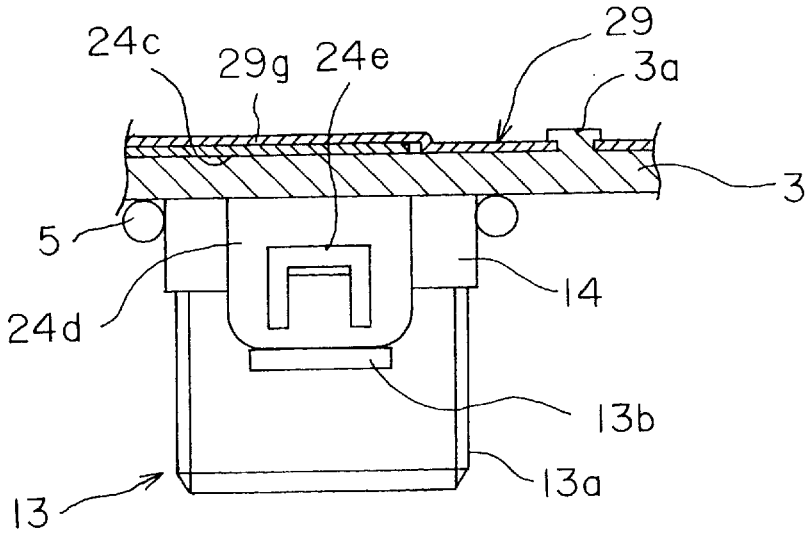
FIG. 9*b* is a side view showing the constitution when the fixing plate and board bracket are constituted as separate bodies in an embodiment of the automobile antenna relating to the present invention.
Figure 9C:
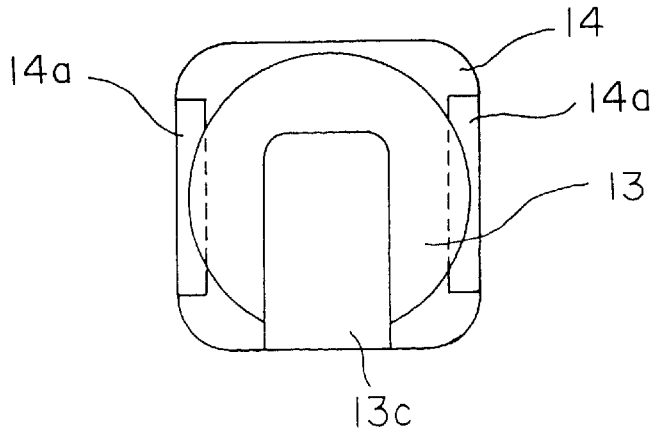
FIG. 9*c* is a bottom view showing the constitution when the fixing plate and board bracket are constituted as separate bodies in an embodiment of the automobile antenna relating to the present invention.

FIGS. 9*a*, 9*b*, and 9*c* show the constitution wherein the fixing plate 24 is fixed to the base portion 3 by the board bracket 29 having the constitution explained above. FIG. 9*a* is a cross sectional view showing the constitution of when the side plates 24*d* of the fixing plate 24 are inserted through the rectangular hole 14*a* formed in the base portion 3 and the board bracket 29 is attached thereon. FIG. 9*b* is a side view of the same constitution as seen from the front of the side plates 24*d*. FIG. 9*c* is a bottom view of part of the base portion 3.

As shown in these figures, when the fixing plate 24 is fixed, the side plates 24*d* of the fixing plate 24 are inserted in the rectangular holes 14*a* formed in the base portion 3. Next, the board bracket 29 is mounted thereon, and at this time, the three engaging holes 29*b* are respectively engaged with the three engaging projections 3*a* of the base portion 3 so that the upper plate 24*c* of the fixing plate 24 is housed inside the stepped portion 29*g* of the board bracket 29. Then, when the engaging projections 3*a* are caulked, the upper plate 24*c* of the fixing plate 24 is held between and attached to the base portion 3 and the stage portion 29*g* of the board bracket 29 as shown in FIGS. 9*a* and 9*b*. The waterproof O-ring 5 is fit into the base of the rectangular projecting portion 14 of the base portion 3.

In the case of providing the fixing plate 29 of this second constitution, the antenna body 1 is temporarily anchored to the roof panel 20 by the action of the spring pieces 24*a*, after the cylindrical projecting portion 13 and rectangular projecting portion 14 are inserted in the antenna mounting hole 21. Consequently, without the antenna body 1 being held by a worker, the fixing nut 2 can be screwed from within the vehicle body onto the threaded portion 13*a* formed on the outer surface of the cylindrical projecting portion 13 of the antenna body 1 that is temporarily anchored. In this way, the antenna body 1 can be fixed to the roof panel 20 by one worker, even with the fixing plate 29 with the second constitution.

Moreover, a stepped portion 29*g* is formed on the board bracket 29 in the abovementioned constitution wherein the fixing plate 24 and board bracket 29 are formed as separate pieces. However, the present invention is not limited by this and it is also possible to hold and fix the fixing plate 24 with the base portion 3 and board bracket 29 without the formation of the stepped portion 29*g*.

Also, the element portion 8 can be constructed so as to be removed from the antenna cover 1*a* so that the element portion 8 is not damaged by the impact of rotary brushes of a car washing machine while washing the vehicle or by contact with the ceiling of a parking garage.

Industrial Applicability

Because the present invention has the abovementioned type of constitution, when a rectangular projecting portion formed on the base portion is inserted through the mounting hole formed in the vehicle body, the spring portions formed on the fixing plate engage with the mounting hole and temporarily hold the antenna body to the vehicle body. Consequently, [with the antenna] in this state, the antenna body can be mounted on the vehicle body by a worker entering the vehicle body and screwing and tightening the fixing nut onto the threaded portion.

The automobile antenna can therefore be mounted on the vehicle body by just one worker.

Also, the fixing plate has a squared U-shaped cross section; the fixing plate is attached by inserting the opposite side plates formed with spring portions inclined outwards through the hole portions formed in the base portion. Accordingly, the fixing plate can be attached with sufficient strength to the base portion. In this case, the board bracket, formed as a single piece with the fixing plate, is attached to the base portion; the board bracket is attached to the base portion so that the fixing plate is held by the base portion and board bracket.

Furthermore, part of the side surface of the cylindrical projecting portion along the side plates of the fixing plate is cut away, so that the surface of the side plates on the fixing plate do not project outwards from the side surfaces of the cylindrical projecting portion. As a result, when the cylindrical projecting portion formed on the base portion is inserted in the mounting hole formed in the vehicle body, the cylindrical projecting portion can be smoothly inserted into the mounting hole without the fixing plate located on the side surface of the cylindrical projecting portion striking the edge portion of the mounting hole.

What is claimed is:

1. An automobile antenna base portion for fixing an antenna body having an antenna element to a vehicle body comprising;

a rectangular projecting portion to be inserted in a rectangular mounting hole formed in the vehicle body and a cylindrical projecting portion extending from the rectangular projecting portion and onto which a fixing nut disposed inside the vehicle body is screwed;

a fixing plate having spring portions formed on opposite side plates thereof so as to incline outwards, and the side plates being inserted through holes formed in said base portion and project from a rear surface of said base portion, said spring portions engaging an edge of the mounting hole and temporarily fixing said antenna body to said vehicle body when said rectangular projecting portion is inserted in said mounting hole; the fixing plate being formed integrally as a single piece with a board bracket for holding a printed wiring board fixed to the surface of said base portion and formed to have a U-shaped cross section.

2. The automobile antenna, according to claim 1, wherein a part of a side surface of said cylindrical projecting portion is notched along the side plates of said fixing plate, so that the surfaces of the side plates of the fixing plates do not project outwards beyond the side surface of said cylindrical projecting portion.

3. An automobile antenna base portion for fixing an antenna body having at least an antenna element to a vehicle body comprising;

a rectangular projecting portion for insertion in a rectangular mounting hole formed in the vehicle body and a cylindrical projecting portion, extending from the rectangular projecting portion and onto which a fixing nut disposed inside the vehicle body is screwed;

a fixing plate having a U-shaped cross section and spring portions formed on opposite side plates thereof, the side plates being inserted through holes formed in said base portion and project from a rear surface of said base portion; said spring portions engaging an edge of the mounting hole and temporarily fixing said antenna body to said vehicle body when said rectangular projecting portion is inserted in said mounting hole, said fixing plate is held between and fixed to said base portion and a board bracket by fixing the board bracket for supporting a printed wiring board to said base portion.

4. The automobile antenna, according to claim 3, wherein a part of a side surface of said cylindrical projecting portion is notched along the side plates of said fixing plate, so that the surfaces of the side plates of the fixing plates do not project outwards beyond the side surface of said cylindrical projecting portion.

* * * * *

UNITED STATES PATENT AND TRADEMARK OFFICE

CERTIFICATE OF CORRECTION

PATENT NO. : 6,486,841 B1 
DATED : November 26, 2002
INVENTOR(S) : Hirotsugu Imahigashi It is certified that error appears in the above-identified patent and that said Letters Patent is hereby corrected as shown below:

Title page,
Item [54], the correct title should read -- AUTOMOBILE ANTENNA -- not "CAR ANTENNA"

Signed and Sealed this

Sixth Day of May, 2003

JAMES E. ROGAN
*Director of the United States Patent and Trademark Office*